United States Patent [19]

Noyori

[11] Patent Number: 4,930,480

[45] Date of Patent: Jun. 5, 1990

[54] AIR-FUEL RATIO CONTROL SYSTEM

[75] Inventor: Takahiro Noyori, Hamamatsu, Japan

[73] Assignee: Suzuki Jidosha Kogyo Kabushiki Kaisha, Shizuoka, Japan

[21] Appl. No.: 341,790

[22] Filed: Apr. 21, 1989

[30] Foreign Application Priority Data

Apr. 30, 1988 [JP] Japan ..... 63-108664

[51] Int. Cl.[5] ..... F02D 41/14

[52] U.S. Cl. ..... 123/440; 123/179 G

[58] Field of Search ..... 123/440, 489, 589, 491, 123/179 G

[56] References Cited

U.S. PATENT DOCUMENTS

| | | | |
|---|---|---|---|
| 4,224,913 | 9/1980 | Barnard | 123/440 |
| 4,497,296 | 2/1985 | Nakajima et al. | 123/489 |
| 4,759,332 | 7/1988 | Morozumi | 123/489 |

FOREIGN PATENT DOCUMENTS

| | | | |
|---|---|---|---|
| 58-101243 | 6/1983 | Japan | 123/491 |

*Primary Examiner*—Andrew M. Dolinar

*Attorney, Agent, or Firm*—Flynn, Thiel, Boutell & Tanis

[57] ABSTRACT

An air-fuel ratio control system for controlling the air-fuel ratio in an internal combustion engine includes an arrangement for switching from open control of the air-fuel ratio to feedback control thereof. A water temperature sensor is provided for detecting the engine water temperature, and a control unit for controlling the air-fuel ratio is also provided. The control unit includes an arrangement for switching from open control to feedback control when the engine water temperature reaches a selected value. The selected value is determined by the control unit in response to a detection signal received from the water temperature sensor at the time the engine is started.

2 Claims, 4 Drawing Sheets

AIR-FUEL RATIO CONTROL SYSTEM

FIELD OF THE INVENTION

The present invention relates to an air-fuel ratio control system and, more particularly, to an air-fuel ratio control system for achieving an effective air-fuel ratio control by switching from open control to feedback control in response to an output signal generated by a sensor.

BACKGROUND OF THE INVENTION

In internal combustion engines for vehicles, the running speed or rotational speed and load of the engine are highly variable. Various operating conditions based on the combination of both variable factors are required to achieve low fuel cost and less harmful exhaust gas. This necessitates a proper control of the air-fuel ratio in the various operating conditions.

For the proper control of the air-fuel ratio, a feedback type air-fuel ratio control system is used for regulating the air-fuel ratio to obtain the optimum combustion state at all times in relation to the operating conditions A control valve is actuated in response to an output signal from an exhaust sensor for sensing the contents of the exhaust gas to control the supply of bleed air for the control of the air-fuel ratio.

An air-fuel ratio control system has been disclosed by Japanese Provisional Publication of Patent Application No. 59-103940, and uses a process for controlling starting fuel for an internal combustion engine which includes detection of the temperature of induction air in the engine after the start of the engine to determine an increment of the supplied fuel, in order to save fuel costs as well as to optimize drivability factors influenced by the engine.

With the conventional air-fuel ratio control system, control of the air-fuel ratio was achieved by switching from open control to feedback control when a water temperature sensor sensed that the water temperature of the engine had gone above a predetermined value. Open control basically refers to air-fuel ratio control which is achieved without the use of exhaust sensors or the like as feedback sensors.

In case the engine water is at a raised temperature at the start of the engine, as shown by FIG. 6, the oil temperature is also at a raised level, and so this may cause no inconvenience whatsoever. But if the engine water is at a low temperature when the engine starts, as shown in FIG. 7, the oil temperature is seen not to have risen appreciably even at the time when the engine water has reached the predetermined starting water temperature for feedback control.

This will result in a great loss of the power output of the engine, and inconveniently cause the air fuel ratio becomes lean, as shown by a broken line in FIG. 5, from about A/F 13 to about A/F 14.7 (theoretical air Fuel ratio) thereby inviting a decrease in the rotational speed of the engine and engine trouble. These problems are the result of the initiation of feedback control before the oil temperature is sufficiently increased.

Furthermore, the process for controlling the fuel at starting of the internal combustion engine as disclosed by the provisional publication of Patent Application No. 59-103940 needs a sensor for detecting the induction air temperature of the engine, which makes the structure complicated and expensive, leading to the inconvenience of economical disadvantages.

An object of the present invention is, in order to aid in eliminating the above-described inconveniences, to provide an air-fuel ratio control system which includes a water temperature sensor for detecting the engine water temperature and a control unit which is adapted to receive a detection signal from the water temperature sensor at the start of the engine so as to select a water temperature for starting feedback control. The system controls the air-fuel ratio by switching from open control to feedback control when the engine water temperature has reached the selected starting water temperature With this structure, decreases in the rotational speed of the engine and damage to the engine at the stage of transition from open control to feedback control can be avoided, and such structure need not be complicated and expensive.

SUMMARY OF THE INVENTION

For the purpose of attaining this object, the present invention provides an air-fuel ratio control system for controlling the air-fuel ratio by switching from open control to feedback control in response to an output signal from a sensor. The system includes a water temperature sensor for detecting the engine water temperature and a control unit for controlling the air-fuel ratio by switching from open control to feedback control when the engine temperature has reached a water temperature for starting feedback control, which water temperature is selected in accordance with a detection signal received from the water temperature sensor at the start of the engine.

The above described structure is such that the control unit receives a detection signal from the water temperature sensor at the start of the engine so as to select a water temperature for starting feedback control. The control unit controls the air-fuel ratio by switching from open control to feedback control when the actual engine water temperature has reached the selected water temperature. This structure functions so as to avoid decreases in the rotational speed of the engine and damage to the engine at the stage of transition from open control to feedback control, and such structure need not be complicated and expensive.

BRIEF DESCRIPTION OF THE DRAWINGS

An exemplary embodiment of the present invention is described in detail hereinafter in connection with the drawings, in which.

DETAILED DESCRIPTION

The embodiment of the present invention will be described in detail with reference to the drawings.

Figure 1:
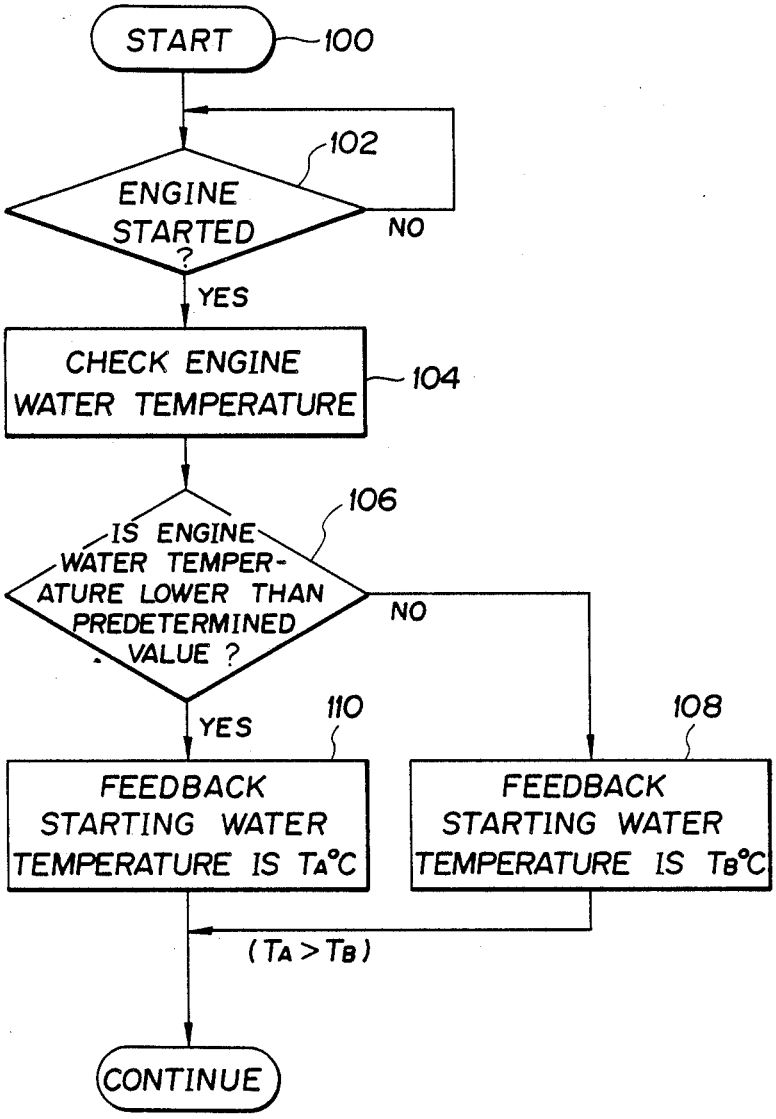
FIG. 1 is a flow chart showing a sequence for air-fuel ratio control of an internal combustion engine according to the present invention.
Figure 2:
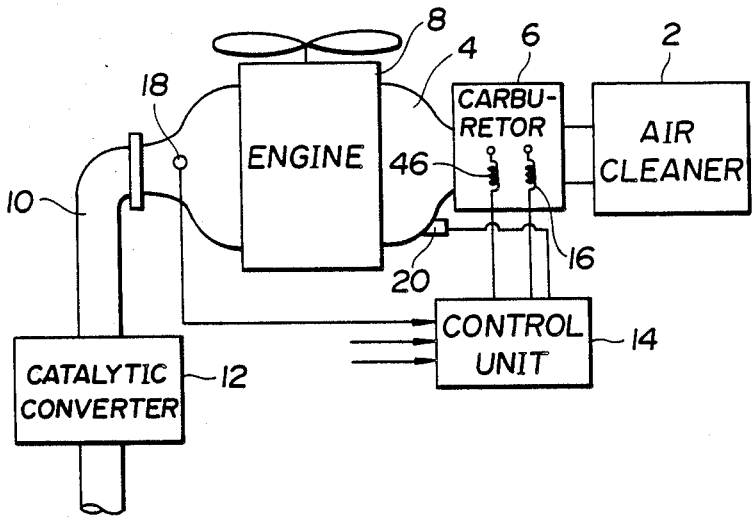
FIG. 2 is a diagrammatic view of an internal combustion engine which can implement the sequence of FIG. 1.

FIGS. 1–5 show the embodiment of the present invention. In FIG. 2, the numeral 2 is an air cleaner and 4 a suction or intake pipe. Near the midpoint of the suction pipe 4, and downstream of the air cleaner 2, is provided an electronically-controlled Venturi-type carburetor 6 which communicates through pipe 4 with an end of a combustion chamber (not shown) of an engine 8. An exhaust tube 10 communicates with the combustion chamber also, the exhaust tube 10 having a catalytic converter 12 containing a ternary catalyst and provided near the midpoint of the exhaust tube 10 for performing after-exhaust treatment. The carburetor 6 is provided with an electrically controlled valve 16 which is controlled for opening and closing by a control unit 14 which will be described later.

In order to detect the operating conditions of the engine, an $O_2$ sensor 18 is provided within the exhaust tube 10 as an exhaust sensor for detecting the concentration of exhaust gas, that is the concentration of $O_2$. For the purpose of the air-fuel ratio control, the arrangement is such that the control unit 14 receives a detection signal from the $O_2$ sensor 18 and a detection signal generated by a water temperature sensor 20. The water temperature sensor 20 is mounted on the engine 8, and generates a detection signal when the engine starts. The detection signal from the water temperature sensor 20 is used to select a starting water temperature for feedback control, as described later. Control of the air-fuel mixture is switched from open control to feedback control when the engine water temperature reaches the preset starting temperature.

Specifically, as shown in FIG. 1, if the engine water temperature, detected by means of the water temperature sensor 20 immediately after the start of the engine 8, is higher than a predetermined value, preferably −20° C., the starting water temperature for feedback control is set to $T_B$° C., namely 20° C. If the engine water temperature at the time of starting the engine is lower than −20° C., the starting water temperature for feedback control is set to $T_A$° C., namely 40° C. Thus, when the engine water temperature subsequently reaches 20° C. or 40° C., whichever the circumstances dictated at start-up, open control is switched to feedback control so that the air-fuel ratio control is effected by the control unit 14 as a function of the $O_2$ sensor. In other words, after feedback control is initiated, the control unit 14 responds to the $O_2$ sensor 18 to adjust the air-fuel ratio.

Figure 3:
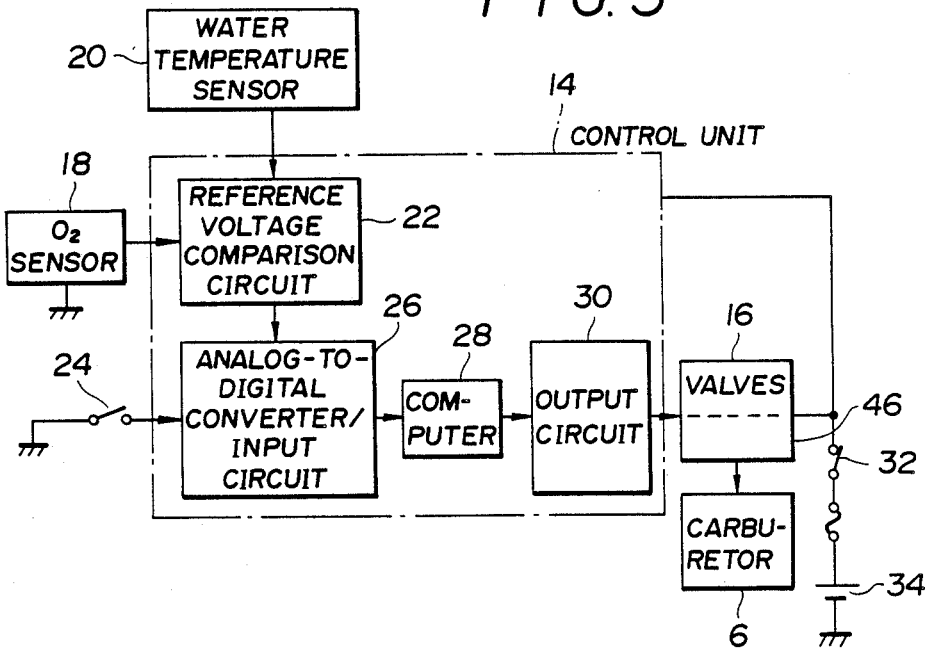
FIG. 3 is a block diagram showing an air-fuel ratio control system which is part of the internal combustion engine of FIG. 2.

As shown in FIG. 3, the control unit 14 includes: a reference voltage comparison circuit 22 for receiving detection signals from the $O_2$ sensor 18 and the water temperature sensor 20 and for comparing the voltage corresponding to the engine from temperature obtained from the water temperature sensor 20 with a reference voltage; and an input circuit 26 with an A/D converter for receiving output signals from an idle switch 24 and the reference voltage comparison circuit 22 and for performing the A/D conversion. The control unit 14 also includes: a computer 28 for receiving an output signal from the input circuit 26 and for executing various kinds of arithmetic operations for control; and an output circuit 30 for receiving an output signal from the computer 28 and for outputting it to the valve 16 and a slow-cut valve 46, which will be explained hereinafter. Reference numeral 32 indicates an ignition switch and 34 indicates a battery.

Figure 4:
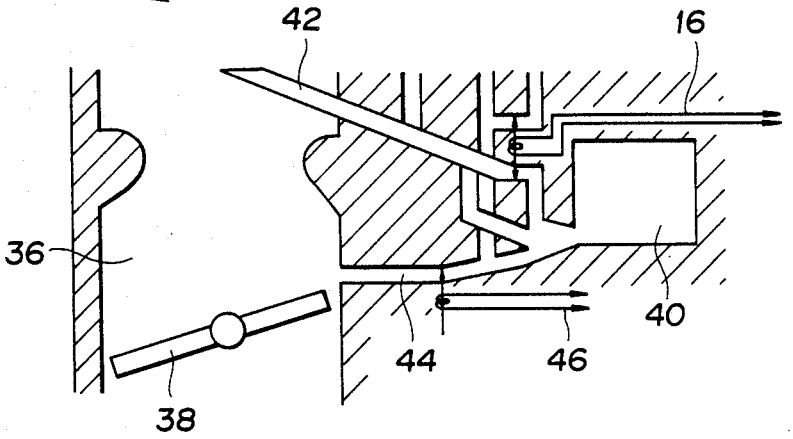
FIG. 4 is a diagrammatic cross-sectional view of a carburetor of the internal combustion engine of FIG. 2.
Figure 6:
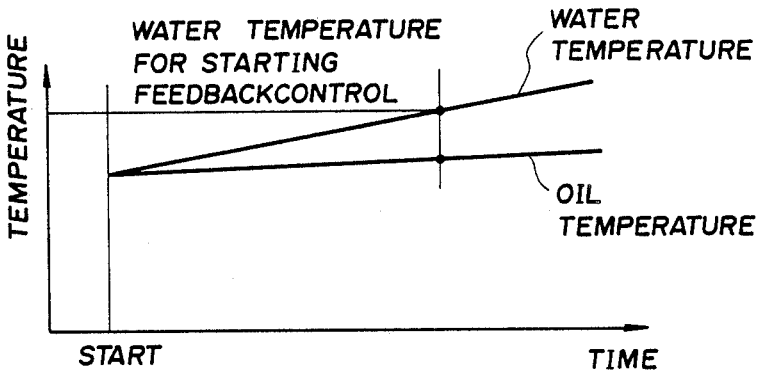
FIG. 6 is a graph showing the relationship between engine water temperature and oil temperature with respect to time when the engine water has a high temperature when the engine is started.
Figure 7:
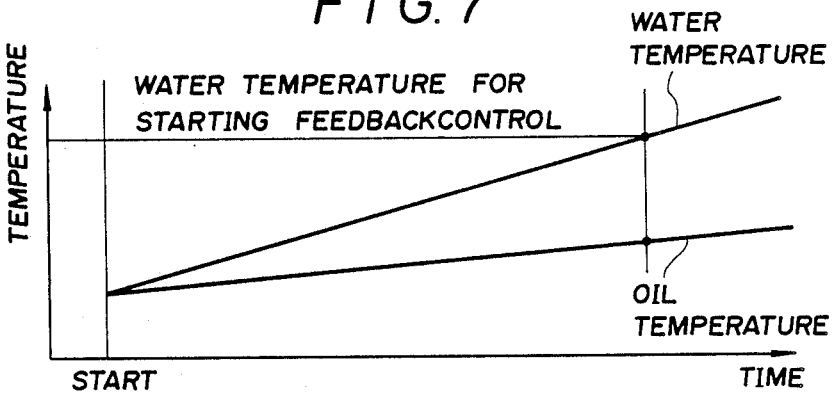
FIG. 7 is a graph showing the relationship between engine water temperature and oil temperature with respect to time when the engine water has a low temperature when the engine is started.
Figure 5:
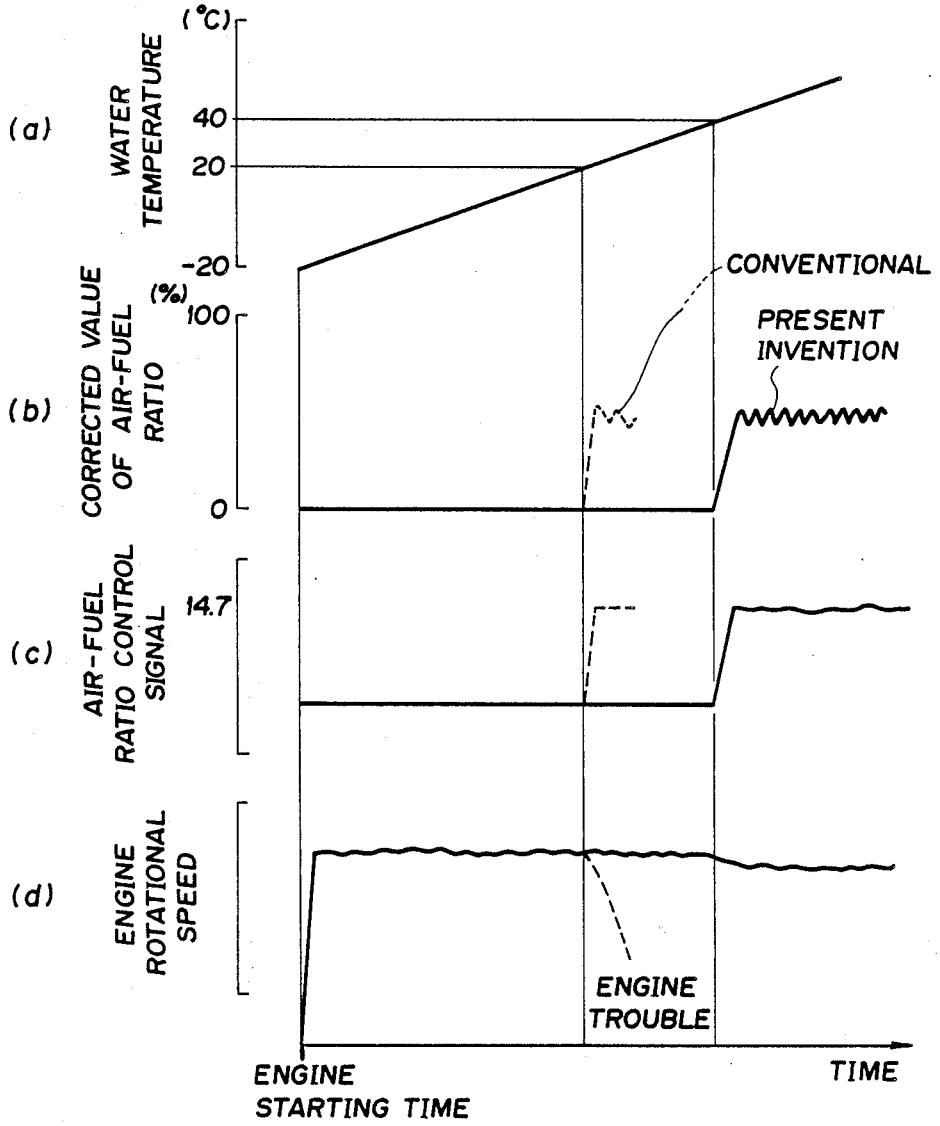
FIGS. 5*a*–5*d* are each a graph showing a respective operating condition of the engine of FIG. 2 as it warms up after it is started.

As shown by FIG. 4, the carburetor 6 has the valve 16, a suction line 36, a throttle valve 38, a float chamber 40, a main fuel line 42, and a slow fuel line 44 which is provided with the slow-cut valve 46 controlled by the control unit 14 for opening and closing fuel line 44. The main fuel line 42 has the valve 16 provided therein. The control unit 14 controls the opening and closing of the valve 16.

Next, the air-fuel ratio control in the embodiment of the present invention will be described with reference to the flow chart of FIG. 1.

The program for the air-fuel ratio control starts with step 100 and determines at step 102 whether or not the engine 8 has been started. If not, this judgement operation is repeated at the step 102 until the answer is yes. If yes, the engine water temperature is detected at step 104 by means of the water temperature sensor 20. It is then determined at step 106 whether or not the engine water temperature is lower than the predetermined temperature value. If not, the engine water temperature is higher than −20° C. and, at step 108, the starting water temperature for feedback control is set to 20° C.

If yes at step 106, the engine water temperature is lower than −20° C., and the starting water temperature for feedback control is set to 40° C. at step 110.

This enables the water temperature for starting feedback control to be changed from 20° C. to 40° C. if the engine water temperature is found to be lower than −20° C. at the start of the engine, thereby avoiding any decrease in the rotational speed of the engine or damage to the engine at the stage of transition from open control to feedback control, and rendering the engine operating condition stable.

Since it is only necessary to modify the programs contained within the control unit 14 for any operational procedure, no additional number of parts is required. In addition to the possibility of improving the reliability of the parts, this feature also prevents complication of the configuration, ensuring low cost and the economic advantage associated therewith.

It is to be noted that the present invention is not restricted to the above embodiment and that variants and other applications are possible.

For example, this particular embodiment of the present invention has set the comparative predetermined value for the engine water temperature at the start of the engine to −20° C., and uses that value to determine whether the water temperature for starting feedback control is 20° C. or 40° C. However, by using two or more comparative predetermined values to select one of several separate water temperatures for starting feedback control, a decrease in the rotational speed of the engine or damage to the engine at the stage of transition from open control to feedback control is more easily avoided, and the operating condition of the engine could be rendered more stable.

As described above, in accordance with the present invention, a control unit is provided along with a water temperature sensor for detecting the engine water temperature at the time the engine is started. The water temperature sensor provides a detection signal which the control unit uses to determine a starting water temperature at which feedback control is to begin. When the engine water temperature has reached the predetermined starting water temperature for feedback control, open control is switched to feedback control to control the air-fuel ratio. In this manner, any decrease in the rotational speed of the engine or damage to the engine at the stage of transition from open control to feedback control can be avoided, thus stabilizing the operating conditions of the engine.

A mere change of a program stored in the control unit can accommodate any operational procedures, so that no additional number of parts is required. This feature may help improve the reliability of the parts used, ensuring low cost and the economic advantage associated therewith.

Although a particular preferred embodiment of the invention has been disclosed in detail for illustrative purposes, it will be recognized that variations or modifications of the disclosed apparatus, including the rearrangement of parts, lie within the scope of the present invention.

The embodiment of the invention in which an exclusive property of privilege is claimed is defined as follows:

1. An air-fuel ratio control system for an engine having intake and exhaust pipes, comprising: temperature sensor means for sensing a temperature in the engine; exhaust gas sensor means for sensing the concentration of an exhaust gas in the exhaust pipe; fuel supply means for supplying an air-fuel mixture to the intake pipe; and control means for determining a change temperature in dependence on an engine start temperature detected by said temperature sensor means when the engine is started, for thereafter controlling said air-fuel mixture produced by said fuel supply means independently of said exhaust gas sensor means until the engine temperature detected by said temperature sensor means reaches said change value, and for thereafter controlling said air-fuel ratio produced by said fuel supply means as a function of an output of said exhaust gas sensor means; wherein when said detected start temperature is respectively below and above a predetermined temperature said change temperature is determined to be a respective one of a first temperature and a second temperature greater than said first temperature; and wherein said predetermined temperature is −20° C., said first temperature is 20° C., and said second temperature is 40° C.

2. A system of claim 1, wherein said temperature sensor means senses the temperature of engine cooling water.

* * * * *